United States Patent [19]

Pickering

[11] 4,420,710

[45] Dec. 13, 1983

[54] CO-AXIAL MAGNETRONS

[75] Inventor: Alan H. Pickering, Chelmsford, England

[73] Assignee: English Electric Valve Company Limited, Chelmsford, England

[21] Appl. No.: 292,749

[22] Filed: Aug. 14, 1981

[30] Foreign Application Priority Data

Aug. 14, 1980 [GB] United Kingdom ..... 8026569

[51] Int. Cl.[3] ..... H01J 25/50

[52] U.S. Cl. ..... 315/39.77; 315/39.51

[58] Field of Search ..... 315/39.77, 39.51, 39.75, 315/39.53

[56] References Cited

U.S. PATENT DOCUMENTS

| | | | |
|---|---|---|---|
| 2,231,781 | 2/1941 | Liscio | 315/39.77 |
| 2,446,826 | 8/1948 | McArthur | 315/39.77 X |
| 2,854,603 | 9/1958 | Collier et al. | 315/39.77 |
| 3,034,014 | 5/1962 | Drexler | 315/39.77 |
| 3,169,211 | 2/1965 | Drexler et al. | 315/39.77 |
| 3,379,926 | 4/1968 | Symes | 315/39.77 X |
| 3,471,744 | 10/1969 | Pryor | 315/39.77 |
| 3,582,707 | 6/1971 | Hynes | 315/39.77 |
| 3,706,910 | 12/1972 | Foreman | 315/39.77 |
| 4,194,142 | 3/1980 | Gerard | 315/39.77 |

*Primary Examiner*—Saxfield Chatmon

*Attorney, Agent, or Firm*—Spencer & Frank

[57] ABSTRACT

A co-axial magnetron in which in order to provide attenuation of slot resonances the axial coupling slots in the anode member are opened out at either end into round apertures into which resistive attenuating material is introduced in the form of discs having thicknesses corresponding to the thickness of the wall of the anode member. The discs are held in place by thin copper cylinders inside and outside of the anode wall member and overlapping the attenuating discs on either side.

9 Claims, 3 Drawing Figures

CO-AXIAL MAGNETRONS

BACKGROUND OF THE INVENTION

This invention relates to co-axial magnetrons. A typical co-axial magnetron as at present known is represented in highly schematic manner in FIGS. 1 and 2 of the accompanying drawings of which FIG. 1 is a section in plan and FIG. 2 is a section in elevation. Referring to FIGS. 1 and 2, the magnetron consists of two concentric cylinders, an outer cylinder 1 and an inner cylinder 2, coaxial with the longitudinal axis of the magnetron. Between cylinders 1 and 2 is the main cavity 3 of the magnetron. The main cavity 3 is short-circuited at either end by shorting end plates 4 and 5 extending towards the outer and inner cylinders 1 and 2.

The inner cylinder 2 comprises an anode member of the magnetron and has a plurality of inwardly extending radial vanes or partitions 6 which define between them a multiplicity of subsidiary cavities 7, alternate ones of which are coupled to the main cavity 3 by means of axially extending slots 8 extending through the wall of the inner cylinder 2.

One problem suffered by co-axial magnetrons as described above is unwanted oscillation in what are termed "slot modes". The axially extending coupling slots 8 have but slight electrical excitation in the intended mode of oscillation but have large currents along their lengths in the unwanted "slot modes" of oscillation. These large currents flow up one edge of the slot and down the other.

The usual method of attenuating such unwanted "slot modes" is to introduce a thin cylinder of resistive material co-axial with and inside the inner cylinder 2 arranged to overlap the ends of the coupling slots 8. Usually such attenuating cylinders of resistive material are provided at both ends of the cylinder 2 as shown in FIG. 2 where the cylinders of resistive material are represented by the numeral 9.

If as is often the case currents induced in the resistive attenuating material of the cylinder 9 by the currents in the slots result in heating then the cylinders tend to expand into the wall of the inner cylinder 2 (which is usually of copper) which then conducts the heat away for dissipation.

It has been found that utilising this form of attenuation has two disadvantages particularly when applied to magnetrons of high average power or long wavelength (two factors which usually occur together). Firstly the relatively large size of each cylinder of resistive attenuating material (which is usually brittle) can result in fractures occurring under conditions of rapid or uneven heating and secondly the cylinders of resistive attenuating material can absorb power from currents in the wanted mode of oscillation which currents flow up the inside of the inner cylinder 2 on the metal between the attenuating slots 8. One object of the present invention is to reduce or avoid such difficulties.

SUMMARY OF THE INVENTION

According to this invention a co-axial magnetron is provided having an outer main resonant cavity surrounding an anode member and coupled to a plurality of subsidiary cavities within said anode member via coupling slots and wherein at least one of said coupling slots has therewithin, at at least one end thereof, resistive attenuating material provided to attenuate undesired slot modes of oscillation.

Said resistive attenuating material is preferably provided at both ends of some or all of said coupling slots.

Preferably said resistive attenuating material is provided in the form of a piece or pieces of material having a thickness at least substantially equal to the thickness of the wall of said anode member through which said slots extend.

Each slot containing resistive attenuating material may open out at one or each end into a round aperture into which said resistive material is inserted in the form of a disc.

Each piece of resistive attenuating material may be held in place within its slot by thin conductive cylinders (preferably of copper) fitted inside and outside of said wall and fixed thereto so as to overlap said piece.

DETAILED DESCRIPTION OF A PREFERRED EMBODIMENT

Figure 1:
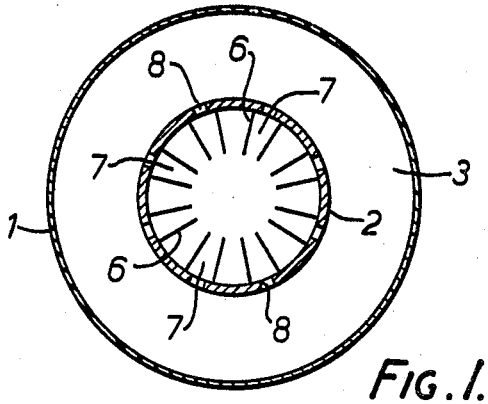
FIG. 1 is a section in plan of a known co-axial magnetron.
Figure 2:
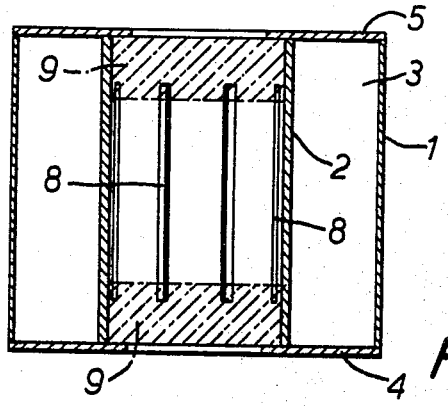
FIG. 2 is a section in elevation of the magnetron of FIG. 1.
Figure 3:
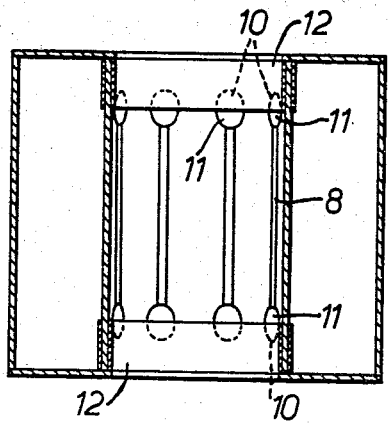
FIG. 3 is a section in elevation of the magnetron of the present invention.

In FIG. 3, the same reference numerals are used as in FIG. 2 to identify corresponding parts.

Referring to FIG. 3 it will be seen that each slot 8 has a central elongated portion and at each end opens out into a round aperture 10 which is conventionally formed in practice by drilling. Inserted within each round aperture 10 is a disc 11 of resistive attenuating material. The diameter of each disc 11 corresponds to that of the round aperture 10 and has a thickness (a dimension perpendicular to the plane of the drawings) which corresponds to the thickness of the cylinder 2.

At either end inside and outside of the cylinder 2 are the copper cylinders 12 which overlap the discs 11 and so retain these within the round apertures 10. It will be appreciated that the inner ones of the thin copper cylinders 12 occupy positions previously occupied in the known tube by the conventional slot mode attenuating cylinders.

It will be noted that with a construction as shown in FIG. 3 the individual pieces of resistive attenuating material are relatively small and thus relatively resistant to thermal shock and since the pieces are within the slots themselves they tend only to absorb power from currents flowing in the slots i.e. slot modes.

As previously if absorbed heat tends to cause the attenuating material to expand it does so into the copper shell which then conducts the heat away for dissipation.

I claim:

1. A co-axial magnetron comprising:

an outer cylinder having a longitudinal axis;

an anode member coaxial with said longitudinal axis and surrounded by said outer cylinder, the space between said anode member and said outer cylinder forming a main resonant cavity;

partition means connected to said anode member for forming a plurality of subsidiary cavities within the space defined by said anode member, said anode member having a plurality of slots extending through the wall thereof in the direction of said longitudinal axis for coupling said main resonant cavity to at least one of said subsidiary cavities, each of said slots having an elongated central portion and opposite ends; and a resistive attenuating material located within at least one of said slots at at least one end thereof to attenuate undesired slot modes of oscillation.

2. A magnetron as claimed in claim 1 and wherein said resistive attenuating material is provided at both ends of at least one of said coupling slots.

3. A magnetron as claimed in claim 1 or 2 and wherein said resistive attenuating material comprises at least one piece of material having a thickness at least substantially equal to the thickness of the wall of said anode member through which said slots extend.

4. A magnetron as claimed in claim 1 or 2 and wherein each slot containing resistive attenuating material is opened out at at least one end into a round aperture into which said resistive material is inserted in the form of a disc.

5. A magnetron as claimed in claim 3 and wherein each slot containing resistive attenuating material is opened out at at least one end into a round aperture into which said resistive material is inserted in the form of a disc.

6. A magnetron as claimed in claim 1 or 2 which further comprises first and second coaxial conductive cylinders secured to the inside and outside respectively of the wall of said anode member at at least one end thereof so as to overlap said resistive attenuating material, said attenuating material being thereby interposed between said first and second coaxial conductive cylinders and retained within said slots.

7. A magnetron as claimed in claim 3 which further comprises first and second coaxial conductive cylinders secured to the inside and outside respectively of the wall of said anode member at at least one end thereof so as to overlap said resistive attenuating material, said attenuating material being thereby interposed between said first and second coaxial conductive cylinders and retained within said slots.

8. A magnetron as claimed in claim 4 which further comprises first and second coaxial conductive cylinders secured to the inside and outside respectively of the wall of said anode member at at least one end thereof so as to overlap said resistive attenuating material, said attenuating material being thereby interposed between said first and second coaxial conductive cylinders and retained within said slots.

9. A magnetron as claimed in claim 5 which further comprises first and second coaxial conductive cylinders secured to the inside and outside respectively of the wall of said anode member at at least one end thereof so as to overlap said resistive attenuating material, said attenuating material being thereby interposed between said first and second coaxial conductive cylinders and retained within said slots.

* * * * *